US006769940B2

(12) United States Patent
Nakano

(10) Patent No.: US 6,769,940 B2
(45) Date of Patent: Aug. 3, 2004

(54) CONNECTOR

(75) Inventor: Hiroshi Nakano, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/686,407

(22) Filed: Oct. 14, 2003

(65) Prior Publication Data

US 2004/0077230 A1 Apr. 22, 2004

(30) Foreign Application Priority Data

Oct. 15, 2002 (JP) ..... 2002-299910

(51) Int. Cl.[7] ..... H01R 13/514
(52) U.S. Cl. ..... 439/752
(58) Field of Search ..... 439/752, 352, 439/353, 357, 358

(56) References Cited

U.S. PATENT DOCUMENTS 5,609,503 A 3/1997 Tsuji et al.
5,651,703 A 7/1997 Sasai
5,653,613 A * 8/1997 Shimoda ..... 439/752
5,839,923 A * 11/1998 Yoshida ..... 439/752
6,010,374 A * 1/2000 Miwa ..... 439/752
6,371,818 B1 4/2002 Saito et al. ..... 439/752
2001/0016457 A1 * 8/2001 Taguchi et al. ..... 439/752

* cited by examiner

*Primary Examiner*—Tho D. Ta
(74) *Attorney, Agent, or Firm*—Anthony J. Casella; Gerald E. Hespos

(57) ABSTRACT

A connector (10) has a wide housing (11) with a recess (14) at a weidthwise-middle position. A lock arm (13) is formed in the recess (14) for locking the connector (10) to a mating connector. Cavities (12) are formed in the housing (11) at apposite sides of the recess (14) for receiving terminal fittings (T), and a retainer mount hole (16) in the housing (11) communicates with the cavities (12). A retainer (21) is mounted in the retainer mount hole (16) for locking the terminal fittings (T) in the cavities (12). Engaging structures (28*a*) are provided at an intermediate portion (24) of the retainer (21) for engaging the housing (11) at the recess (14) to prevent warping of the retainer

16 Claims, 8 Drawing Sheets

CONNECTOR

BACKGROUND OF THE INVENTION

1. Field of the Invention

The invention relates to a connector designed to prevent an intermediate portion of a retainer from warping.

2. Description of the Related Art

U.S. Pat. No. 6,371,818 and FIGS. 10(A) to 10(C) show a connector with a retainer to prevent withdrawal of terminal fittings. With reference to FIGS. 10(A) to 10(C), the connector has a housing 1 with a bottom wall. A retainer insertion hole 2 is formed in the bottom wall for receiving a retainer 3 in a direction normal to an inserting direction of terminal fittings. This retainer 3 is held initially at a partial locking position where insertion of the terminal fittings into cavities 1*a* is possible. The retainer 3 then is pushed to a full locking position after the terminal fittings have been inserted. Thus, locking projections 3*a* of the retainer 3 engage the terminal fittings to prevent the withdrawal of the terminal fittings.

The retainer 3 is held at the full locking position by the engagement of end locks 3*b* of the retainer 3 with the opposite ends of the retainer insertion hole 2. However, the housing 1 has many cavities 1*a* arranged side by side in widthwise direction, but only at a small number of stages. Thus, the retainer 3 is long and narrow, and a middle portion of the retainer 3 may warp away from the housing 1 at the full locking position due to an insufficient rigidity. Accordingly, a locking function for the terminal fittings may be insufficient. To offset this problem, intermediate locks 5 are set in an intermediate portion of the retainer 3 and intermediate receiving portions 1*b* are provided in the housing 1. As a result, the retainer 3 is prevented from warping away from the housing 1 at a middle position of the retainer 3. However, the intermediate locks 5 and the intermediate receiving portions 5 complicate efforts to provide a wide housing with cavities at narrow intervals.

The invention was developed in view of the above problems and an object is to provide a narrow, wide connector that prevents an intermediate portion of the retainer from warping.

SUMMARY OF THE INVENTION

The invention relates to a connector with a housing. Cavities are formed in the housing and are configured for accommodating terminal fittings. The cavities are arranged over a longer distance in widthwise direction than in height direction. A retainer mount hole is formed in the housing and communicates with the cavities. A retainer is movable in the retainer mount hole from a first position where insertion of the terminal fittings is permitted to a second position where the terminal fittings are locked. The retainer is locked at least at the second position by locking means at opposite side surfaces of the retainer and the retainer mount hole. A lock arm is provided on a surface of the housing to lock the connector to a mating connector. The cavities are arranged at fewer stages in a forming area of the lock arm than in other neighboring areas. The retainer includes an intermediate portion substantially corresponding to the forming area of the lock arm. Additionally, partition walls overlap opposite side surfaces of a recess in the housing at the forming area of the lock arm when the retainer is at the second position. Engaging means are provided at the overlapping portions for locking the intermediate portion of the retainer.

The intermediate portion of the retainer is engageable with the recess of the housing. Thus, the retainer is locked securely at the second position and very little special space is required for locking in the widthwise and height directions. Accordingly, the retainer will not warp and the connector is made smaller.

The retainer preferably includes partition walls insertable to positions substantially between the respective cavities excluding an intermediate portion corresponding to the forming area of the lock arm.

The retainer mount hole preferably is in the bottom surface of the housing and extends in a widthwise direction.

The second position preferably is reached by inserting the retainer deeper in a mounting direction for holding the terminal fittings by locking sections on the retainer.

The lock arm preferably is at a widthwise middle on the upper surface of the housing, and the recess preferably is recessed from the upper surface of the housing toward the bottom surface of the housing.

The engaging means may include locking projections that project toward the opposite partition walls from the inner surfaces of the partition walls adjacent to the opposite sides of the intermediate portion and slits formed in opposite sides of the recessed portion. The locking projections engage resiliently with the slits when the retainer is at the second locking position. With this arrangement, the intermediate portion of the retainer is locked securely by resiliently engaging the locking projections with the slits and the engaging means has a simple construction.

The housing may have cavities at upper and lower stages, but only at one stage in the intermediate portion of the housing. The intermediate portion of the retainer has only a base plate, whereas side portions of the retainer define a lattice shape. Accordingly, the intermediate portion of the retainer is less rigid and more likely to warp. However, such warping is prevented by the engaging means in the intermediate portion to lock and fix the retainer.

The slits preferably are formed in substantially opposite side surfaces of the recess and correspond to the locking projections. The slits provide communication between the retainer mount hole and clearances between the lock arm and the side surfaces.

The retainer may have a plurality of partition walls coupled into a lattice shape by coupling plates at substantially opposite sides.

Most preferably, the retainer comprises locking means for locking the retainer in the first position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
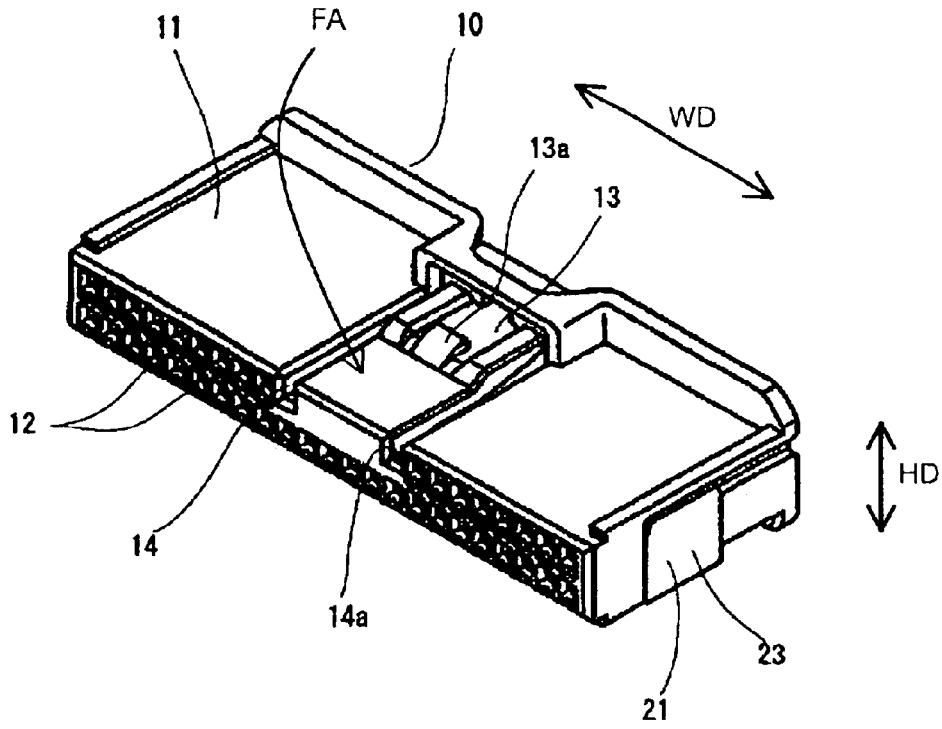
FIG. 1 is a perspective view of a connector according to one preferred embodiment of the invention.

A connector according to the invention is identified by the numeral 10 in FIG. 1. The connector 10 has a housing 11 made e.g. of a synthetic resin and terminal fittings T are inserted cavities 12 in the housing 11 (see FIGS. 7(A) and 7(B)). The housing 11 has width in a width direction WD much greater than its height along a height direction HD. The width preferably is more than four times, more preferably more than 7 times, most preferably more than 10 times the height. The cavities 12 are arranged e.g. in twenty three columns in the widthwise direction WD and at two stages in the height direction HD. The cavities 12 are formed only at the lower stage in the middle six columns and a lock arm 13 is formed at the upper surface. The lock arm 13 is cantilevered back from the front or mating end of the housing 11. Additionally, the lock arm 13 is resiliently deformable vertically towards and away from the housing 11. A locking claw 13*a* projects from the upper surface of the lock arm 13 and can engage lockingly with a mating connector. The upper surface of the lock arm 13 is substantially flush with the upper surface of the housing 11. Thus, a recess 14 is formed in the upper surface of the housing 11 in a forming area FA of the lock arm 13. The recess 14 defines a deformation area for the lock arm 13. The width of the recess 14 exactly corresponds to a sum of the widths of a plurality of columns, e.g. six columns, of the cavities 12, and clearances 14*a* are defined between side surfaces 14S of the recess 14 and the opposite side surfaces of the lock arm 13.

Figure 7A:
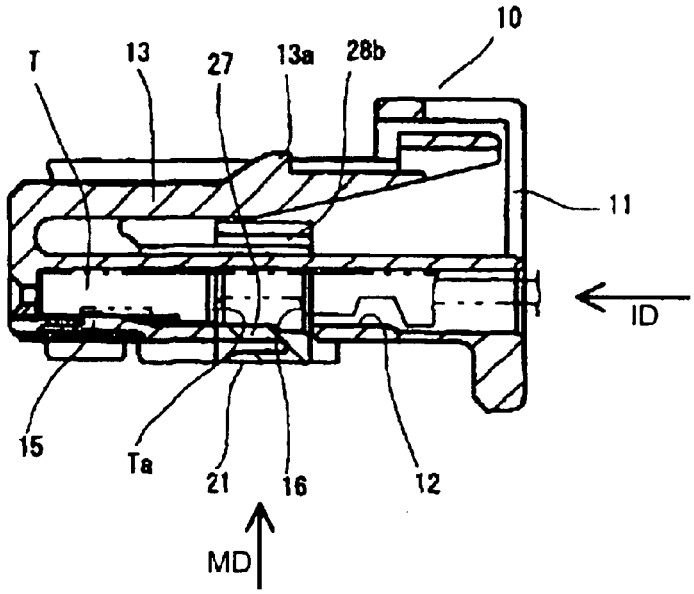
FIGS. 7(A) and 7(B) are sections respectively showing the retainer at a partial locking position and at a full locking position.
Figure 7B:
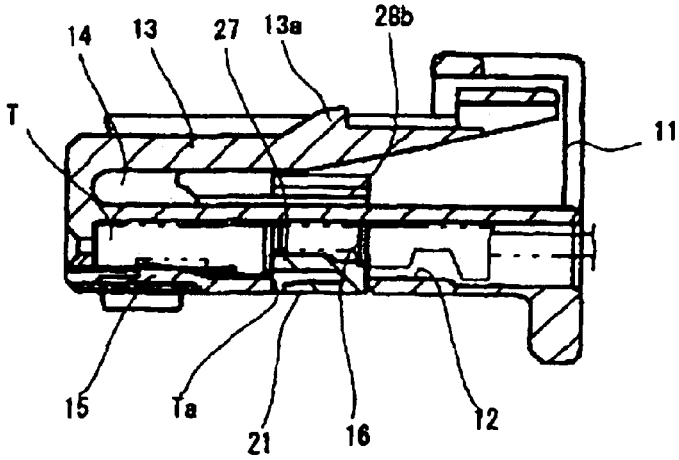

As shown in FIGS. 7(A) and 7(B), the cavities 12 penetrate the housing 11 in forward and backward longitudinal directions and the terminal fittings T are insertable therein from behind along an insertion direction ID. A resiliently deformable lock 15 is provided at a middle of the bottom surface of each cavity 12 as shown in FIG. 4(A) for engaging the corresponding terminal fitting T.

Figure 2:
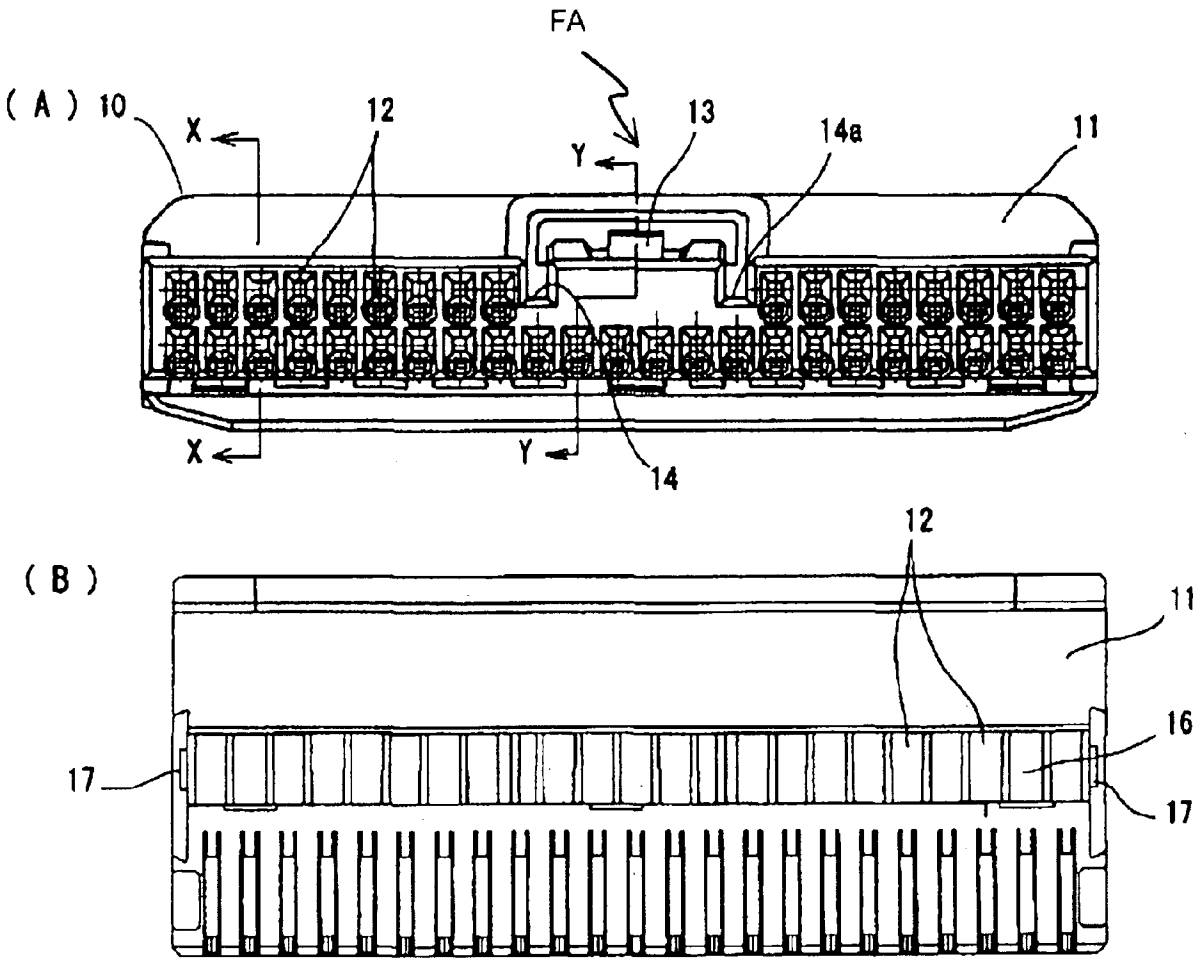
FIGS. 2(A) and 2(B) are a front view and a plan view of a housing.
Figure 3:
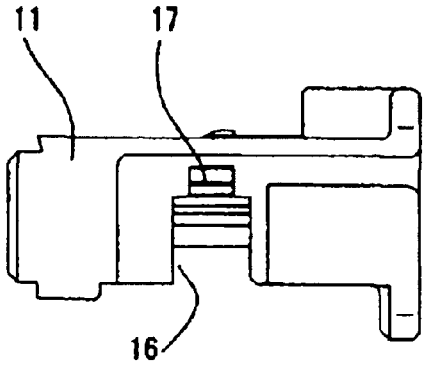
FIG. 3 is a side view of the housing.
Figure 4A:
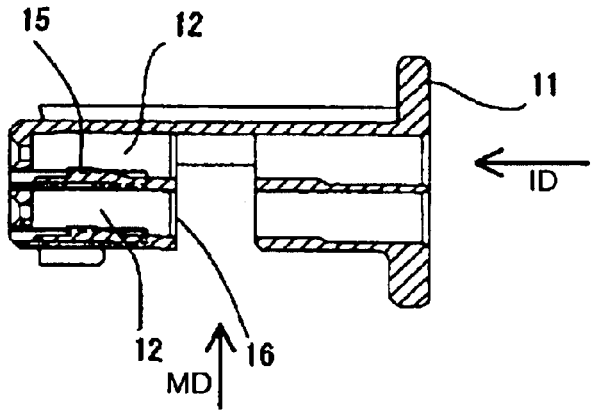
FIGS. 4(A) and 4(B) are sections along 4(A)—4(A) and 4(B)—4(B) of FIG. 2(A).
Figure 4B:
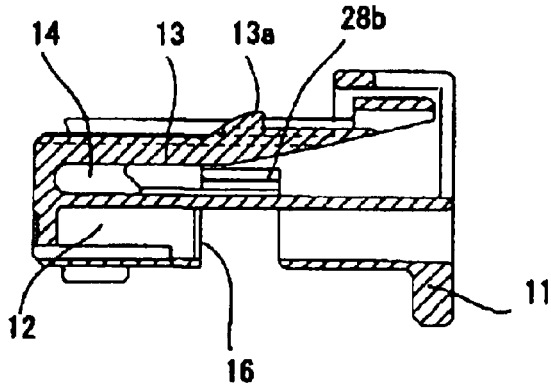
Figure 5:
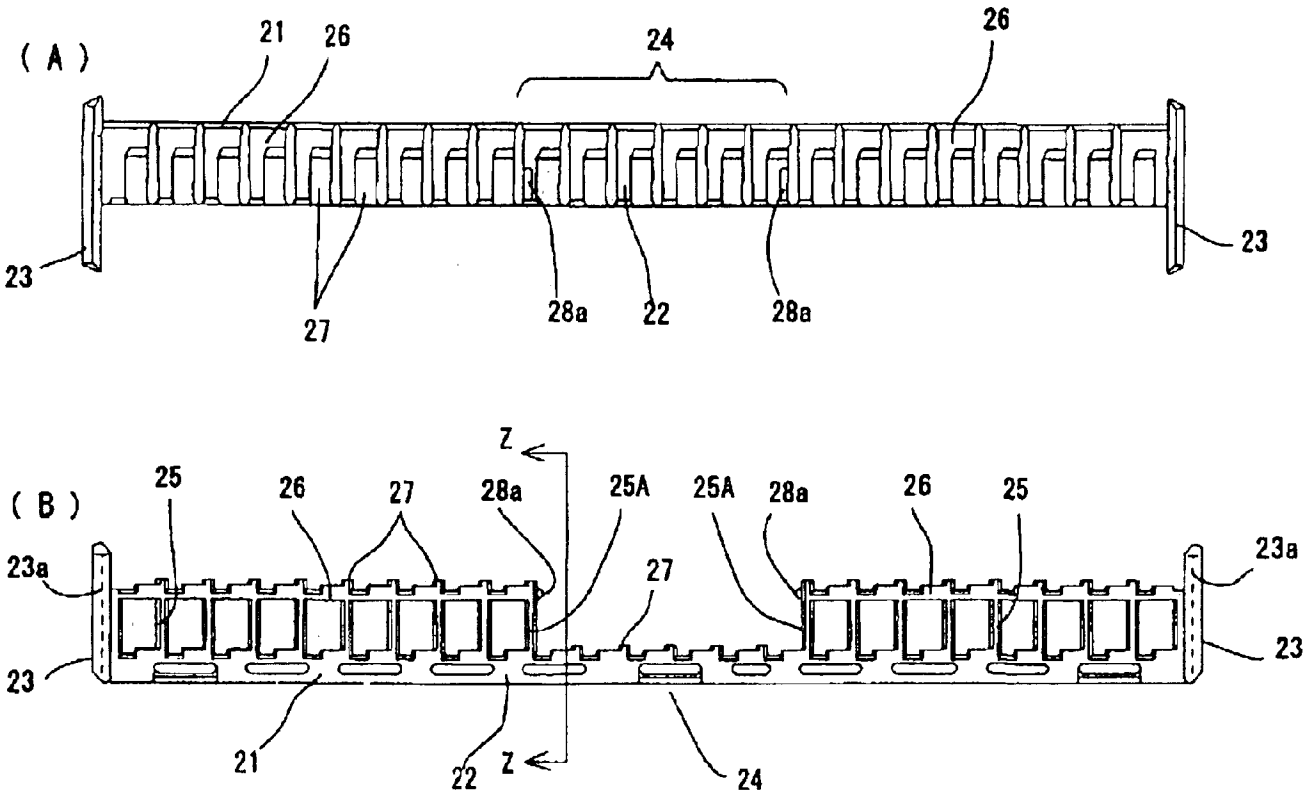
FIGS. 5(A) and 5(B) are a plan view and a front view of a retainer.

A retainer mount hole 16 is formed in the bottom wall of the housing 11 over substantially the entire width, as shown in FIG. 2(B), and communicates with the cavities 12 as shown in FIGS. 4(A) and 4(B). A retainer 21 is mountable in the mount hole 16 in a mounting direction MD that is substantially normal to the inserting direction ID. The retainer mount hole 16 has a depth corresponding to the number of stages (e.g. one stage) for the (e.g. six) cavities 12 in the forming area FA of the lock arm 13. Engaging projections 17 project at each of the side walls of the housings 11 at opposite ends of the retainer mount hole 16, as shown in FIG. 3. The engaging projections 17 hold the retainer 21 at a partial locking position with a small insertion depth in the mounting direction MD and at a full locking position with a large insertion depth in the mounting direction MD.

Figure 8:
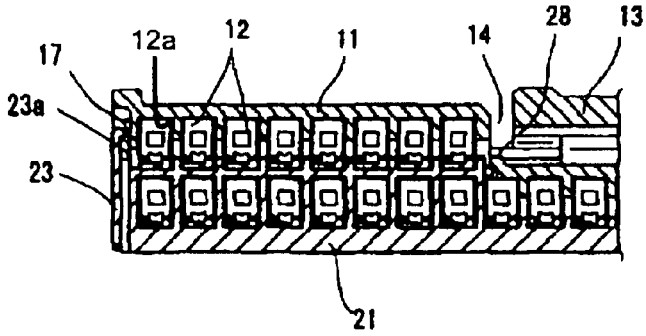
FIG. 8 is a lateral section of a left half of the connector showing the state where the retainer is located at the partial locking position.

The retainer 21 is made e.g. of a synthetic resin similar to the housing 11 and has a substantially flat base plate 22 with a width substantially corresponding to the width of the housing 11. Integral or unitary side plates 23 project vertically up at opposite lateral ends of the base plate 22. A locking recess 23a is formed in the inner surface of each side plate 23 for engaging the engaging portion 17 of the housing 11 at the partial locking position and the full locking position. A locking means is formed by the locking recesses 23*a* and the engaging portions 17 (see FIG. 8) for locking and fixing the opposite lateral end surfaces of the retainer 21.

The retainer 21 has partition walls 25 that project vertically up from the base plate 22 substantially parallel to partition walls 12*a* between adjacent cavities 12 in the housing 11. The partition walls 25 are at both sides of the retainer 21, but are not in an intermediate portion 24 corresponding to the forming area FA of the lock arm 13. The partition walls 25 are insertable to positions adjacent the cavities 12 at the upper stage when the retainer 21 is mounted properly in the retainer mount hole 16. Upper ends of the partition walls 25 are joined by coupling plates 26 to define a lattice-shaped frame except in the intermediate portion 24. Projections 27 project from the upper surfaces of the base plate 22 and the coupling plates 26. The projections 27 are engageable with,the rear ends of connecting portions Ta of the terminal fittings T that have been inserted to their proper positions in the cavities 12 to hold the terminal fittings T. The projections 27 have a projecting distance that permits the insertion of the terminal fittings T without interference at the partial locking position of the retainer 21. However, the projections 27 engage and lock the terminal fittings T when the retainer 21 is pushed to the full locking position (see FIGS. 7(A) and 7(B)).

Figure 6A:
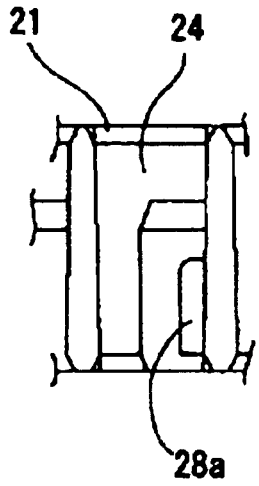
FIGS. 6(A) and 6(B) are a partial enlarged plan view and a partial enlarged front view showing an essential portion of the retainer.
Figure 6B:
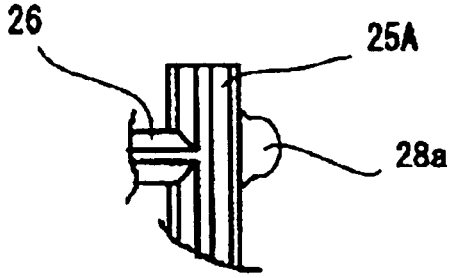
Figure 6C:
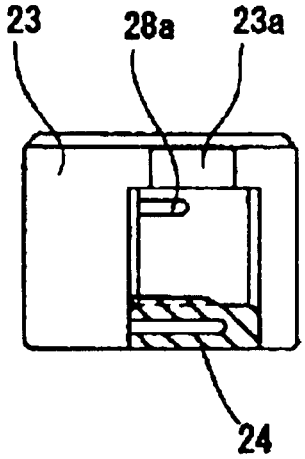
FIG. 6(C) is a section along 6(C)—6(C) of FIG. 5(B).
Figure 9A:
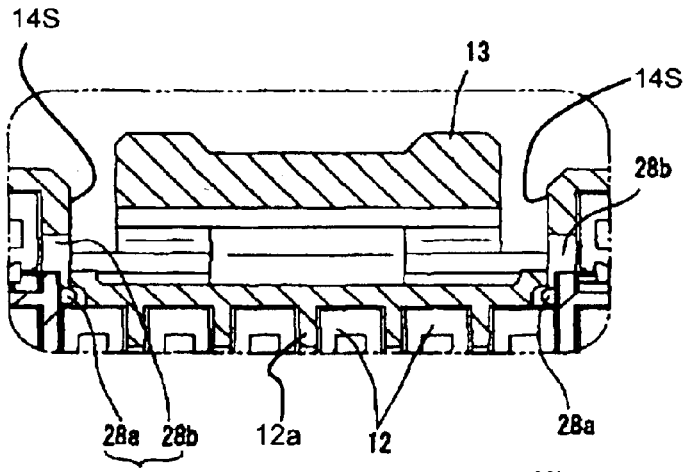
FIGS. 9(A) and 9(B) are partial enlarged sections showing an essential portion of an engaging means when the retainer is at the partial locking position and when the retainer is at the full locking position.

The partition walls 25A adjacent the opposite sides of the intermediate portion 24 of the retainer 21 overlap opposite side surfaces 14S of the recess 14, when the retainer 21 is at the full locking position. Engaging means 28 are provided between the partition walls 25A and the opposite side surfaces 14S of the recess 14 for preventing the intermediate portion 24 from warping. The engaging means 28 include substantially linear locking projections 28*a* (see FIGS. 6(A) and 6(B)) that face the inner surface of the opposite partition wall 25A and extending in an inserting direction ID of the terminal fittings T. The engaging means 28 also include slits 28*b* in opposite side surfaces 14S of the recess 14. The slits 28*b* communicate the retainer mount hole 16 and the clearances 14*a* (see FIGS. 9(A) and 9(B)). The intermediate portion 24 of the retainer 21 can be held lockingly by engagement of the slits 28*b* and the locking projections 28*a*.

The retainer 21 is pushed lightly in the mounting direction MD into the retainer mount hole 16 of the housing 11 (see FIG. 7(A)). Thus, the locking recesses 23*a* of the opposite side plates 23 of the retainer 21 engage the corresponding engaging projections 17 at the upper stage of the housing 11 (see FIG. 8). Accordingly, the retainer 21 is held at the partial locking position and projects slightly from the bottom surface of the housing 11.

Figure 9B:
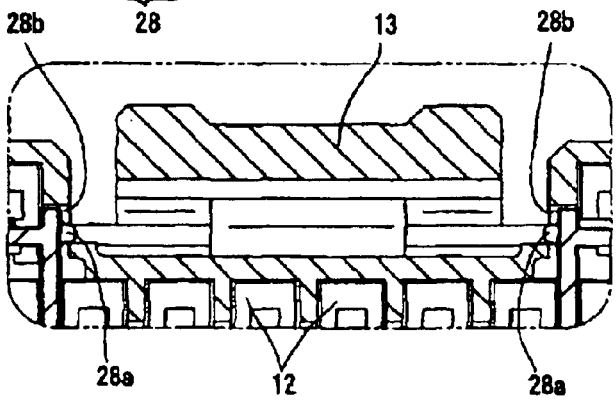
Figure 10A:
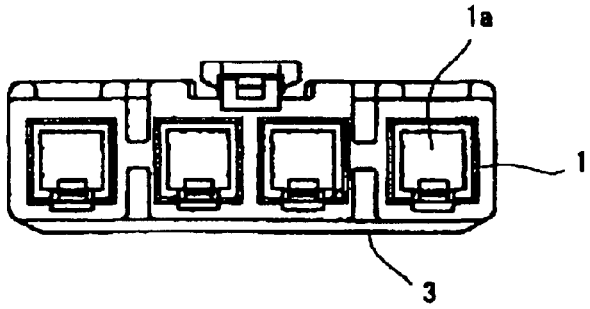
FIG. 10(A) PRIOR ART
FIGS. 10(A) and 10(B) are a front view and a bottom view of a prior art connector and FIG. 10(C) is a front view of a retainer thereof.
Figure 10B:
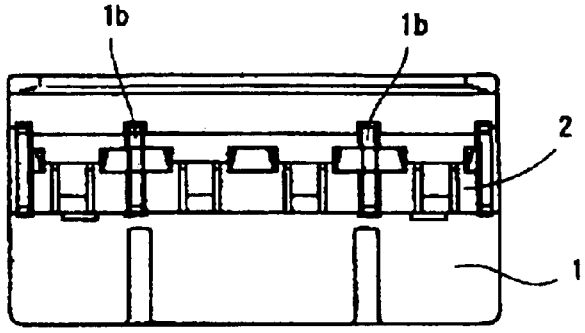
FIG. 10(B) PRIOR ART
Figure 10C:
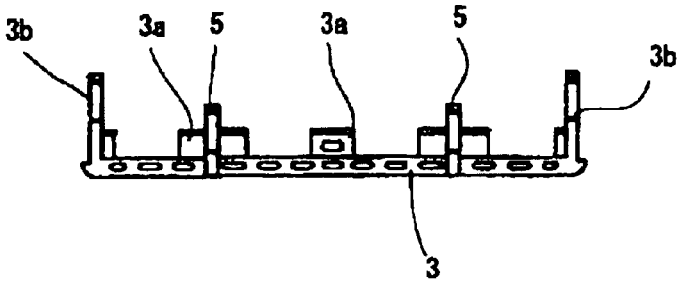
FIG. 10(C) PRIOR ART

The terminal fittings T then are inserted along the inserting direction ID into each cavity 12 of the housing 11 to a depth where the lock 15 engages the terminal fitting T. Thereafter, the retainer 21 is pushed in the mounting direction MD from the partial locking position to the full locking position (FIG. 7(B)). As a result, the locking recesses 23*a* of the retainer 21 engage the upper projections of the engaging portions 17 of the housing 11 and the locking projections 28*a* on the partition walls 25 at the opposite sides of the intermediate portion 24 engage the slits 28*b* in the recess 14 of the housing 11, as shown in FIG. 9(B). Accordingly, the retainer 21 is pushed evenly into the retainer mount hole 16 over substantially the entire width, and the base plate 22 becomes substantially flush with the bottom surface of the housing 11.

The projections 27 of the retainer 21 correspond to the respective cavities 12 and engage the rear ends of the connecting portions Ta of the terminal fittings T. Thus, the terminal fittings T are locked by the retainer 21. The engaging portions 17 engage the locking recesses 23*a* to lock the opposite ends of the retainer 21 and the locking projections 28*a* engage the slits 28*b* to lock the intermediate portion 24 of the retainer 21. Thus, there is no likelihood that the secondary locking function of the intermediate portion 24 will fail due to the warping of the intermediate portion 24. The coupling plates 26 at opposite sides of the retainer 21 cooperate with the partition walls 25 to form a lattice shape that is difficult to deform. However, the intermediate portion 24 is substantially a single plate and is very likely to deform. Therefore, the above-described measure to prevent warping of the intermediate portion 24 is very important.

The engaging means 28 for preventing warping of the intermediate portion 24 include the locking projections 28*a* at the upper ends of the partition walls 25A and the slits 28*b* in the opposite side surfaces 14S of the recess 14. The recess 14 is the required forming area FA of the lock arm 13 on the upper surface of the housing 11. Thus, the engaging means 28 do not influence the intervals between the cavities 12 and there is no enlargement of the connector 10.

As is clear from the above description, the engaging means 28, 28*a*, 28*b* at the opposite side surfaces 14S of the recess 14 of the housing 11 and the partition walls 25A adjacent opposite sides of the intermediate portion 24 of the retainer 21 engage each other. Thus, the narrow wide retainer 21 will not warp. Further, the engaging means 28, 28*a*, 28*b* are between the partition walls 25A and the recess 14 without additional members in the retainer 21 or the housing 11. Thus, the cavities 12 can be arranged at proper intervals without increasing the width of the connector 10, and the connector 10 is not enlarged.

Although the present invention is applied to the female connector 10 in the foregoing embodiment, it also can be applied to male connectors.

The locking projections 28*a* are in the retainer 21 and the slits 28*b* are in the housing 11 as the engaging means 28 for preventing the warping of the intermediate portion 24 of the retainer 21. However, the projections and the slits may be reversed or replaced by other projections and/or recesses.

Cavities 12 are arranged at two stages except in the intermediate portion of the housing 11 where the lock arm 13 is provided, and only one stage of cavities 12 is arranged at the intermediate portion of the housing 11 in the foregoing embodiment. However, the invention also is applicable to a connector with cavities at three or more stages provided that the intermediate portion 24 of the retainer 21 is likely to deform and warp.

Partition walls 25 substantially correspond to partition walls 12a between adjacent cavities 12. However, fewer partition walls 25 may be provided in the retainer 21 according to the invention, e.g. corresponding to each second partition wall 12*a* between adjacent cavities 12.

What is claimed is:

1. A connector, comprising:

a housing with cavities for accommodating terminal fittings the cavities being arranged over a longer distance in a widthwise direction than in height direction, a retainer mount hole formed in the housing and communicating with the cavities, a recess formed in an outer surface of the housing at an intermediate position along the widthwise direction, the recess having opposite side surfaces, the cavities being arranged at fewer stages in a widthwise areas of the housing corresponding to the recess than in other neighboring areas;

a lock arm formed in the recess of the housing for locking the connector and a mating connector together; p1 a retainer mountable into the retainer mount hole for movement from a first position where insertion of the terminal fittings into the cavities is permitted to a second position where the terminal fittings are locked in the cavities, the retainer having an intermediate portion overlapping the opposite side surfaces of the recess when the retainer is at the second position;

locking means at opposite sides of the retainer for locking the retainer at the second position; and engaging means for locking the intermediate portion of the retainer to the side surfaces of the recess.

2. The connector of claim 1, wherein the retainer includes partition walls insertable between the respective cavities on opposite sides of the intermediate portion.

3. The connector of claim 1, wherein the retainer has a plurality of partition walls coupled into a lattice shape by coupling plates at substantially opposite sides.

4. The connector of claim 1, wherein the retainer mount hole is in a bottom surface of the housing and extends in the widthwise direction.

5. The connector of claim 4, wherein the second position is reached by inserting the retainer deeper in a mounting direction so that locking sections of the retainer hold the terminal fittings.

6. The connector of claim 3, wherein the lock arm is at a widthwise middle position on the upper surface of the housing.

7. The connector of claim 4, wherein the recess is formed in an upper surface of the housing and extends toward the bottom surface of the housing.

8. The connector of claim 1, wherein the engaging means include locking projections on partition walls of the intermediate portion and slits in the opposite sides of the recess, the locking projections being resiliently engaged with the slits when the retainer is at the second position.

9. The connector of claim 8, wherein the slits communicate with the retainer mount hole and clearances being defined between the lock arm and the side surfaces.

10. A connector, comprising:

a housing with opposite front and rear ends, opposite top and bottom surfaces and opposite first and second sides, a recess formed in the top surface of the housing, a first plurality of cavities between the recess and the first side of the housing and a second plurality of cavities between the recess and the second side of the housing, the cavities extending between the front and rear ends of the housing and being configured for accommodating terminal fittings, a retainer mount hole formed in the bottom surface of the housing and communicating with the cavities, first and second engaging portions formed at the first and second sides of the housing and aligned with the retainer mount hole, at least one recess lock formed at the recess and aligned with the retainer mount hole;

a lock arm formed in the recess of the housing for locking the connector and a mating connector together;

a retainer mounted in the retainer mount hole for movement from a first position where insertion of the terminal fittings into the cavities is permitted to a second position where the terminal fittings are locked in the cavities, first and second side locks at opposite sides of the retainer for engaging the first and second engaging portions when the retainer at the second position, an intermediate portion nesting over the recess when the retainer is at the second position, the intermediate portion having at least one intermediate lock for engaging the recess lock when the retainer is at the second position.

11. The connector of claim 10, wherein the lock arm is formed unitarily with the housing.

12. The connector of claim 10, wherein the housing has two retainer locks and the retainer has two intermediate locks.

13. The connector of claim 12, wherein the recess locks are slots formed in side surfaces defining the recess.

14. The connector of claim 13, wherein the intermediate locks are projections that engage in the slots when the retainer is in the second position.

15. The connector of claim 14, wherein the first and second pluralities of cavities are substantially equal in number.

16. The connector of claim 15, wherein the first and second pluralities of cavities define an upper stage of cavities, the housing further comprising a lower stage of cavities between the bottom surface and the housing and both the upper stage of cavities and the recess.

* * * * *